US009356392B2

(12) United States Patent
Kuroda

(10) Patent No.: US 9,356,392 B2
(45) Date of Patent: May 31, 2016

(54) LEVER-TYPE CONNECTOR WITH A LEVER LOCK AND A LEVER LOCK RELEASING PORTION

(71) Applicant: Sumitomo Wiring Systems, Ltd., Yokkaichi, Mie (JP)

(72) Inventor: Shinya Kuroda, Yokkaichi (JP)

(73) Assignee: Sumitomo Wiring Systems, Ltd., Yokkaichi (JP)

( * ) Notice: Subject to any disclaimer, the term of this patent is extended or adjusted under 35 U.S.C. 154(b) by 126 days.

(21) Appl. No.: 14/276,378

(22) Filed: May 13, 2014

(65) Prior Publication Data

US 2014/0349504 A1 Nov. 27, 2014

(30) Foreign Application Priority Data

May 21, 2013 (JP) ..... 2013-107389

(51) Int. Cl.
*H01R 13/62* (2006.01)
*H01R 13/629* (2006.01)
*H01R 13/52* (2006.01)

(52) U.S. Cl.
CPC ..... *H01R 13/62955* (2013.01); *H01R 13/5208* (2013.01); *H01R 13/62938* (2013.01)

(58) Field of Classification Search
CPC ..... H01R 13/62933; H01R 13/62938; H01R 13/62955
USPC ..... 439/372, 157
See application file for complete search history.

(56) References Cited

U.S. PATENT DOCUMENTS 4,875,870 A 10/1989 Hardy et al.
6,905,355 B2 * 6/2005 Fukamachi ..... H01R 13/62933 439/157
7,448,888 B2 * 11/2008 Okano ..... H01R 13/4538 439/157
7,641,485 B2 * 1/2010 Shibata ..... H01R 13/62938 439/157
8,235,742 B2 * 8/2012 Komiyama ..... H01R 13/62977 439/157
9,028,265 B2 * 5/2015 Aoki ..... H01R 13/62933 439/157
2006/0030186 A1 * 2/2006 Toyoda ..... H01R 13/62938 439/157
2007/0010113 A1 * 1/2007 Fukatsu ..... H01R 13/62955 439/157
2014/0113480 A1 * 4/2014 Aoki ..... H01R 13/62933 439/372

FOREIGN PATENT DOCUMENTS

JP 2010-146950 7/2010

* cited by examiner

*Primary Examiner* — Hae Moon Hyeon
(74) *Attorney, Agent, or Firm* — Gerald E. Hespos; Michael J. Porco; Matthew T. Hespos

(57) ABSTRACT

A lever-type connector has an outer housing (40) includes accommodating chambers (44) and lock receiving portions (52) at position facing the accommodating chambers (44) and outer surfaces. Inner connectors (11) are connectable to a mating connector by being inserted into the accommodating chambers (44). A rotatable lever (70) is mounted on the outer surfaces of the outer housing (40). The lever (70) includes locks (76) for restricting rotation of the lever by being fit into the lock receiving portions (52) from outer sides when the lever (70) is assembled with the outer housing (40). The inner connector (10) includes a releasing portion (26) for pressing the locking portion (76) from an inner side to separate the lock (76) from the lock receiving portion (52) when the inner connector (10) is inserted into the accommodating chamber (44).

9 Claims, 11 Drawing Sheets

LEVER-TYPE CONNECTOR WITH A LEVER LOCK AND A LEVER LOCK RELEASING PORTION

BACKGROUND

1. Field of the Invention

The invention relates to a lever-type connector.

2. Description of the Related Art

Japanese Unexamined Patent Publication No. 2010-146950 discloses a lever-type connector with male and female connectors that are connectable to each other. The female connector includes a housing, a wire cover to be mounted on the housing from behind and a lever rotatably supported on the wire cover. The housing includes cavities and terminal fittings connected to end portions of wires are insertable into the cavities. The wire cover is configured to cover the wires extending from the rear surface of the housing from outside. The lever can pull the mating connector into connection with the housing by being rotated from an initial position toward a connection position while engaged with the mating connector.

An external force on the lever during transportation to a wiring harness assembling site may release the lever from a temporarily stopped state on the housing or the wire cover.

The invention was completed based on the above situation and aims to prevent a lever from being unlocked during transportation.

SUMMARY OF THE INVENTION

The invention relates to a lever-type connector with an outer housing that has at least one accommodating chamber, at least one lock receiving portion at a position corresponding to the accommodating chamber and an outer surface. The lever-type connector also has an inner connector inserted into the accommodating chamber and connectable to a mating connector. A lever is mounted displaceably on the outer housing and is configured to displace the mating connector to a position where the mating connector is connected to the inner connector. The lever includes at least one lock for holding the lever on the outer housing by being fit into the lock receiving portion when the lever is assembled with the outer housing. The inner connector includes at least one releasing portion for interacting with the lock to separate the lock from the lock receiving portion when the inner connector is inserted into the accommodating chamber.

The lever preferably is mounted rotatably on the outer surface of the outer housing.

The locking preferably is fit into the lock receiving portion from an outer side.

The inner connector may be held in the accommodating chamber by fitting the releasing portion into the lock receiving portion from the inner side. The releasing portion doubles as a locking structure for holding the inner connector in the outer housing. Thus, an existing locking structure can be reinforced or omitted.

The inner connector includes an inner housing with at least one cavity for receiving a terminal fitting connectable to an end portion of a wire. A seal is arranged to face the inner housing and to seal the wire in a fluid-tight manner. A holder is arranged to face the seal, and the releasing portion projects on an outer surface of the holder.

The seal preferably has a seal hole at a position communicating with the cavity for receiving the wire in a fluid-tight manner, and the holder includes a through hole at a position communicating with the seal hole for loosely receiving the wire.

The releasing portion on the holder engages the lock receiving portion to retain the holder in the outer housing and reliably prevents detachment of the holder from the seal. As a result, the seal exhibits stable sealing.

The outer housing preferably includes a housing main body with the accommodating chamber, and a wire cover to be mounted on the housing main body to cover at least part of the wire drawn out from the inner connector inserted into the accommodating chamber from an outer side.

The lock receiving portion preferably is open on an outer surface of the housing main body. Accordingly, the outer housing is transported with the lever held on the housing main body, and the wire cover can be mounted on the housing main body after the terminal fitting is inserted into the inner connector at the wiring harness assembling site.

The lever preferably is mounted rotatably on the outer surface of the outer housing.

The lock preferably is to be fit into the lock receiving portion from an outer side.

The releasing portion preferably presses the lock from an inner side to separate the lock from the lock receiving portion when the inner connector is inserted into the accommodating chamber.

The inner connector may be held in the accommodating chamber by fitting the releasing portion into the lock receiving portion from the inner side.

The releasing portion may project on an outer surface of the holder.

The lever is held strongly on the outer housing by fitting the lock of the lever into the lock receiving portion of the outer housing from the outer side. Thus, an external force on the lever during transportation to a wiring harness assembling site is not likely to unlock the lock and the lock receiving portion. Further, the releasing portion of the inner connector presses the lock to separate the lock from the lock receiving portion when the inner connector is inserted into the accommodating chamber. Thus, a locking state of the lock and the lock receiving portion can be released automatically without using a tool and the lever can be displaced quickly thereafter. In addition, an inner connector that oriented wrong or erroneously inserted into the wrong accommodating chamber restricts displacement of the lever. Thus, erroneous insertion of the inner connector can be avoided.

These and other objects, features and advantages of the invention will become more apparent upon reading the following detailed description of preferred embodiments and accompanying drawings.

DETAILED DESCRIPTION OF THE PREFERRED EMBODIMENTS

Figure 1:
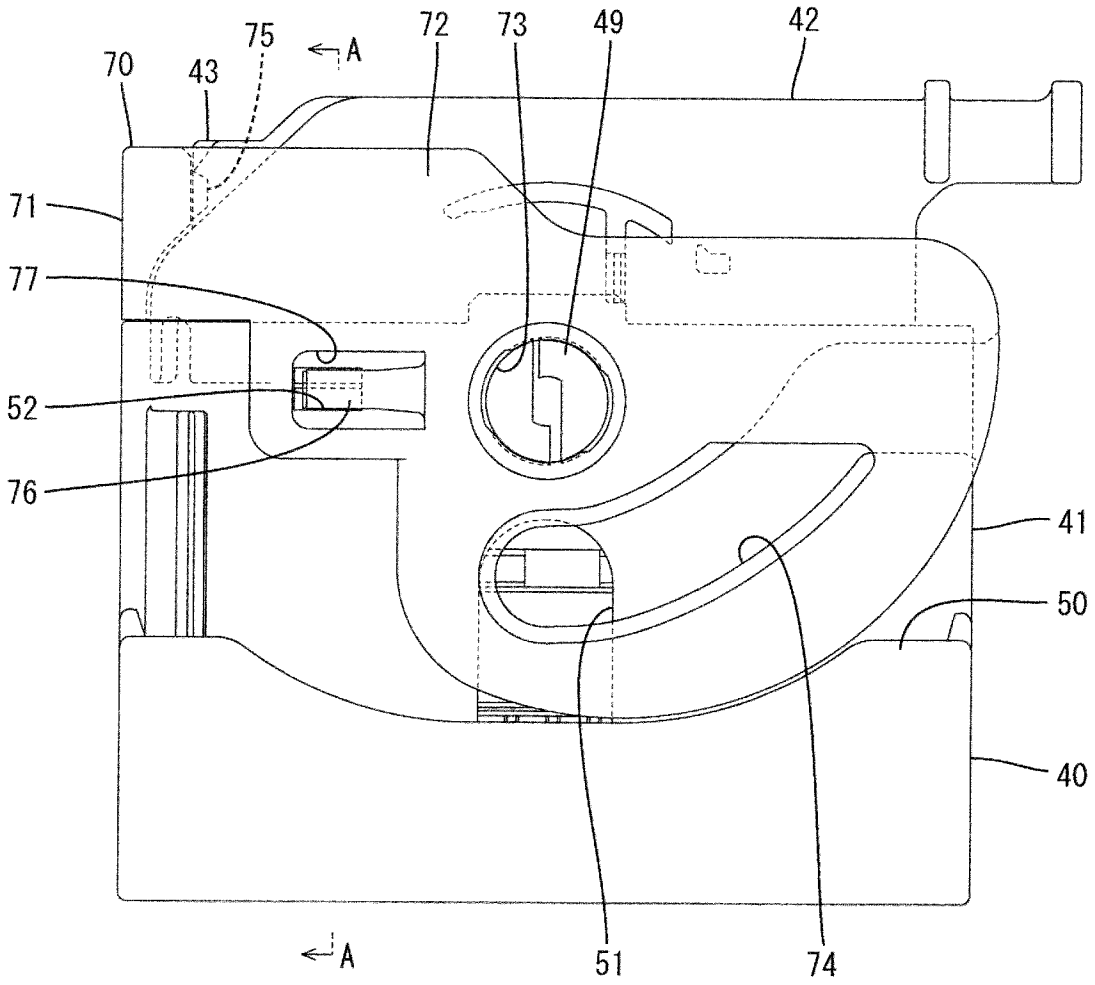
FIG. 1 is a plan view showing a lever held at an assembled position in a lever-type connector of one embodiment of the invention.
Figure 2:
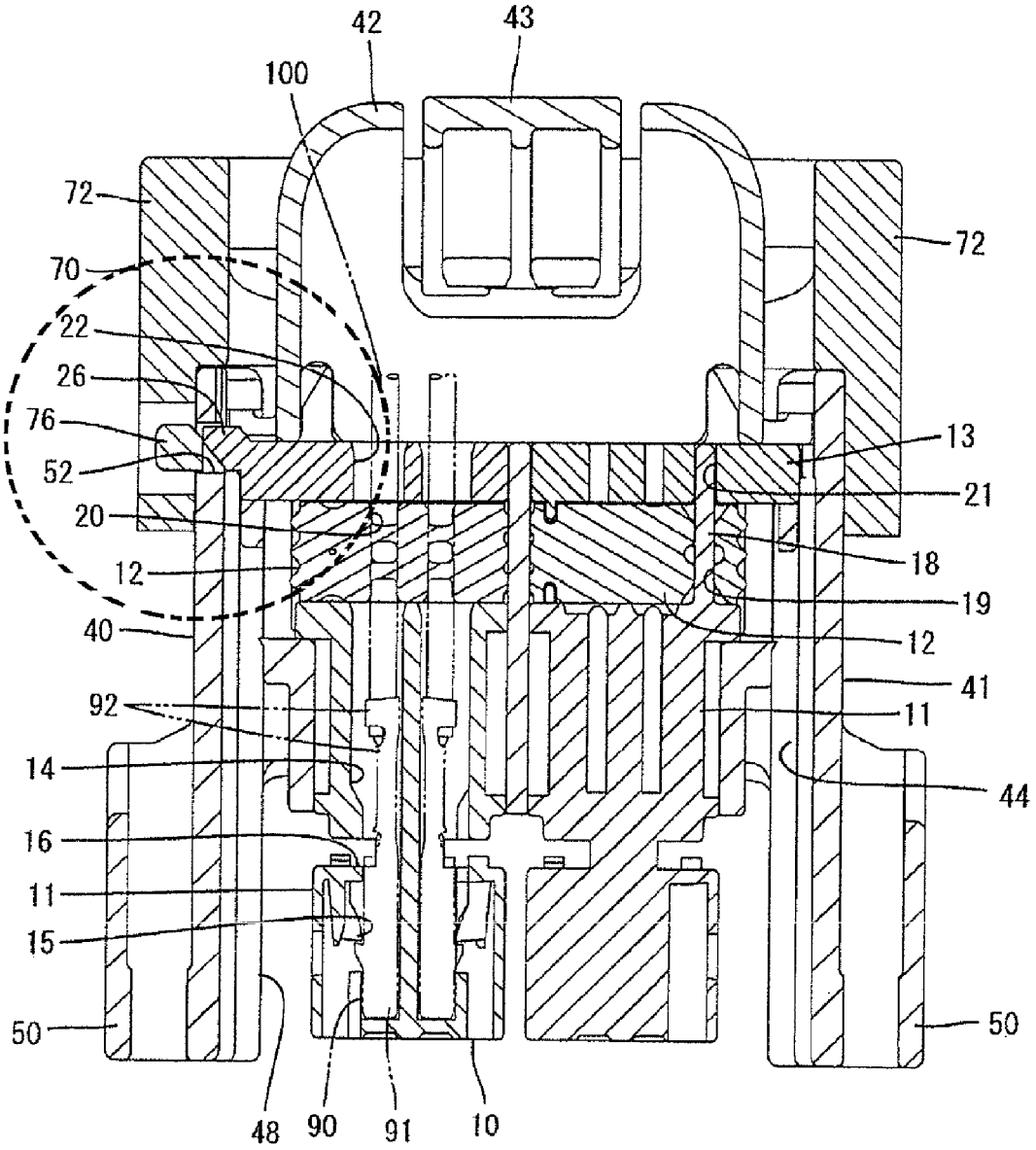
FIG. 2 is a section along A-A of FIG. 1.

One embodiment of the invention is described with reference to FIGS. 1 to 11. A lever-type connector of this embodiment includes two inner connectors 10, an outer housing 40, a lever 70 and terminal fittings 90, as shown in FIG. 2. Each inner connector 10 is connectable to an unillustrated mating connector and includes an inner housing 11, a seal 12 and a holder 13. As shown in FIG. 11, the inner connectors 10 are provided in one lever-type connector so as to be accommodated in two accommodating chambers 44 to be described later. Note that, in the following description, an end to be connected to the mating connector is referred to as a front end concerning a front-back direction.

The inner housing 11 is made of synthetic resin an defines a wide flat block and cavities 14 extend through the inner housing 11 in the front-back direction, as shown in FIG. 2. In this embodiment, the cavities 14 are arranged side by side in the width direction in upper and lower rows. Further, resiliently deflectable locking lances 15 project from inner surfaces of the respective cavities 14 and a retainer mounting hole 16 extends in the width direction immediately behind the locking lances 15 (see FIG. 9). The terminal fittings 90 are inserted into the cavities 14 of the inner housing 11 from behind. Each properly inserted terminal fitting 90 is locked by the locking lance 15 and retained in the cavity 14, and the is locked doubly by a retainer inserted into the retainer mounting hole 16.

The terminal fitting 90 is made of an electrically conductive material such as metal and includes, as shown in FIG. 2, a box-shaped connecting portion 91 and a wire connection barrels 92 connected to and behind the connecting portion 91. The connecting portion 91 is electrically connectable to an unillustrated mating terminal mounted in the mating connector and the wire connection barrel 92 being crimped and connected to an end portion of the wire 100.

Figure 9:
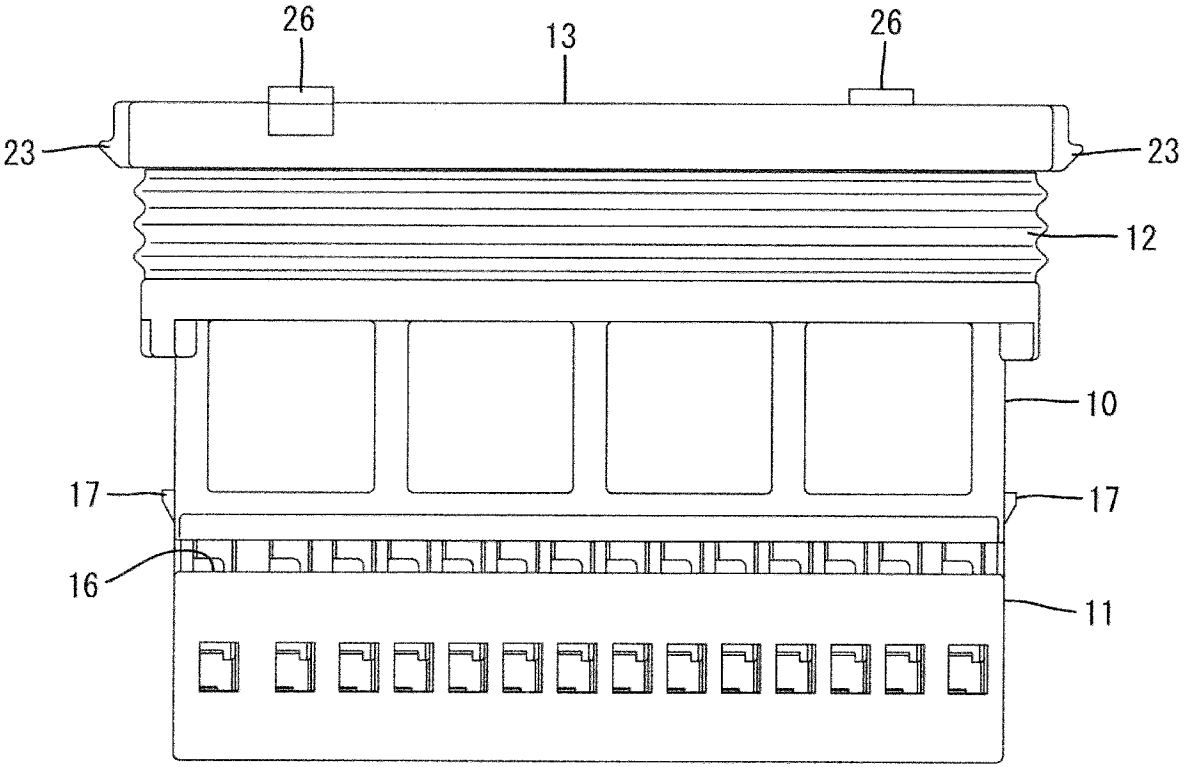
FIG. 9 is a plan view of an inner connector.

As shown in FIG. 9, inner locks 17 project on opposite side surfaces of the inner housing 11 and are capable of locking the outer housing 40. Further, as shown in FIG. 2, holding pieces 18 project back on the rear surface of the inner housing 11 and are capable of holding the holder 13. Although not shown in detail, the holding pieces 18 are paired in the width direction.

The seal 12 is substantially a mat made of resilient material, such as silicon rubber, and i arranged to face and cover the rear surface of the inner housing 11, as shown in FIG. 2. The seal 12 has insertion holes 19 through which base ends of the holding pieces 18 penetrate, and the seal 12 is held on the inner housing 11 via the holding pieces 18 penetrating through the insertion holes 19. Further, the seal 12 is formed with seal holes 20 penetrating at positions communicating with the respective cavities 14. Wires 100 connected to the terminal fittings 90 are to be inserted through the the seal holes 20 of the seal 12 in a fluid-tight manner after the terminal fittings 90 pass so that sealing can be provided around the wires 100. It should be understood that the seal 12 may have a different configuration such as a gelatinous material through with the terminal fittings 90 connected to the wires 100 can be pierced. The gelatinous or elastic material may be a gel or elastic or rubbery material containing three dimensional cross-linked molecular formations or behave as if it contained such molecular formations (geloids). One example of a gel that can be used is silicone gel or resin. Another suitable gel comprises a block copolymer having relatively hard blocks (e.g. hydrogenated rubber blocks) examples of such copolymers including styrene-diene block copolymers (linear or radial) for example styrene-butadiene or styrene-isoprene diblock or triblock copolymers, or styrene-ethylene-butylene-styrenes triblock copolymers. The gel may be formed from a single liquid material that becomes a gel when subjected e.g. to radiation or chemicals; the gel may be formed from two components that become a gel when mixed; or the gel may be a composition that is a gel at working temperature, e.g. room temperature. Additionally a gel material as disclosed in U.S. Pat. No. 4,875,870 may be used, which is included herein by reference.

The holder 13 is substantially in the form of a plate made of synthetic resin and extends along the width direction. The holder 13 faces and covers substantially the entire rear surface of the seal 12, as shown in FIG. 2. Locking holes 21 penetrate the holder and receive tips of the holding pieces 18 to retain the holder 13 on the inner housing 11. Thus, the seal 12 is sandwiched between the inner housing 11 and the holder 13 with the front surface of the seal 12 closely contacting the rear surface of the inner housing 11 and the rear surface of the seal 12 closely contacting the front surface of the holder 13.

Through holes 22 penetrate the holder 13 at positions communicating with the respective seal holes 20. The wires 100 connected to the terminal fittings 90 are to be loosely fit in the through holes 22 of the holder 13. Further, as shown in FIG. 11, holder locks 23 project on opposite side surfaces of the holder 13 and lock to the outer housing 40. The holder 13 has slit-like escaping holes 24 at inner sides of the holder locks 23 to allow deflection of holder locks 23 when the holder 13 is locked to the outer housing 40.

Figure 3:
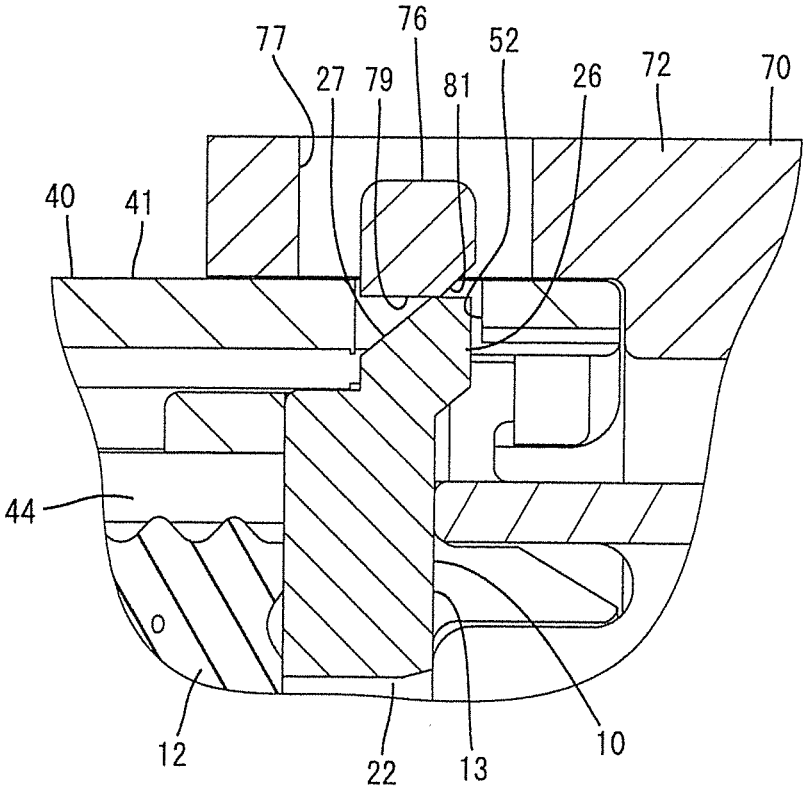
FIG. 3 is a partial enlarged view of FIG. 2.

As shown in FIG. 11, a releasing portion 26 projects on a long side 25 (e.g. upper or lower edge) of the holder 13 at a position displaced laterally from a widthwise center. As shown in FIG. 3, the front of the releasing portion 26 has a rearwardly inclined surface 27, while the rear surface thereof is a substantially perpendicular (e.g. vertically upright) surface. Further, as shown in FIGS. 3 and 9, a rear end part of the releasing portion 26 projects farther back than a main part of the holder 13. As described later, the lever 70 is to be unlocked from the outer housing 40 by the releasing portion 26.

Figure 4:
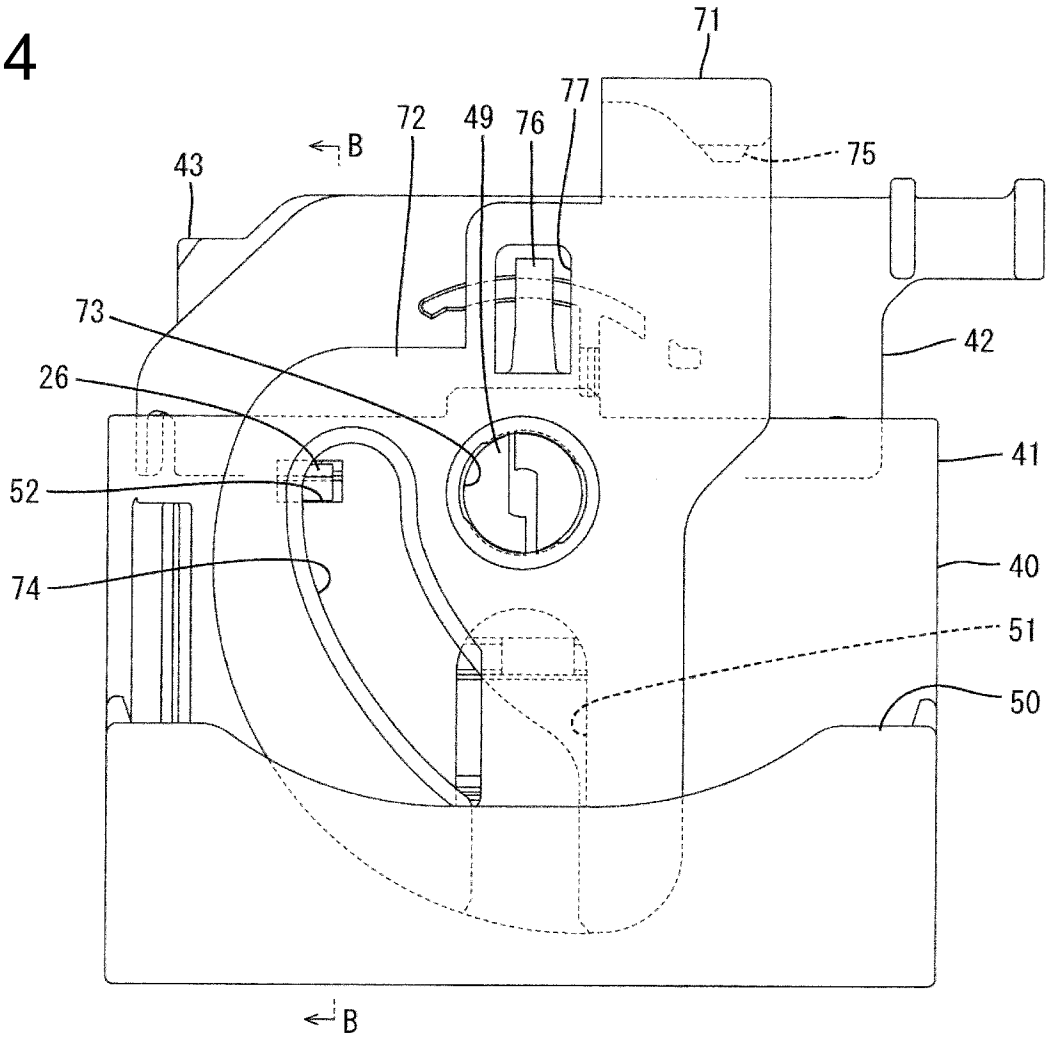
FIG. 4 is a plan view showing the lever held at an initial position.
Figure 5:
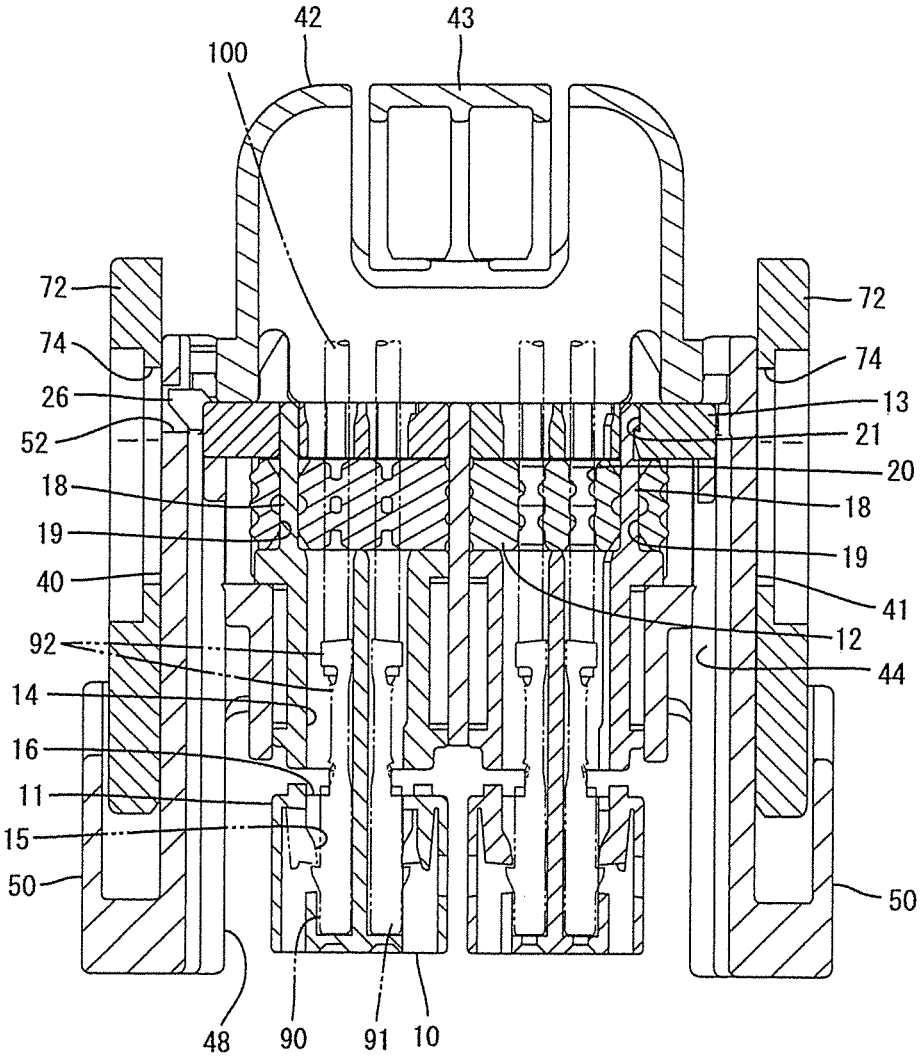
FIG. 5 is a section along B-B of FIG. 4.

The outer housing 40 is made e.g. of synthetic resin and, as shown in FIG. 4, includes a housing main body 41 and a wire cover 42 to be mounted on the rear end of the housing main body 41. The wire cover 42 is in the form of a cap open on a front side and one lateral side. The wires 100 extending from the rear of the inner connectors 10 are bent forcibly by the wire cover 42 and drawn out to outside through the one lateral side of the wire cover 42 when the wire cover 42 is mounted on the housing main body 41. Further, a lever lock receiving portion 43 is provided on a side wall of the wire cover 42 for locking the lever 70 at a connection position.

Figure 7:
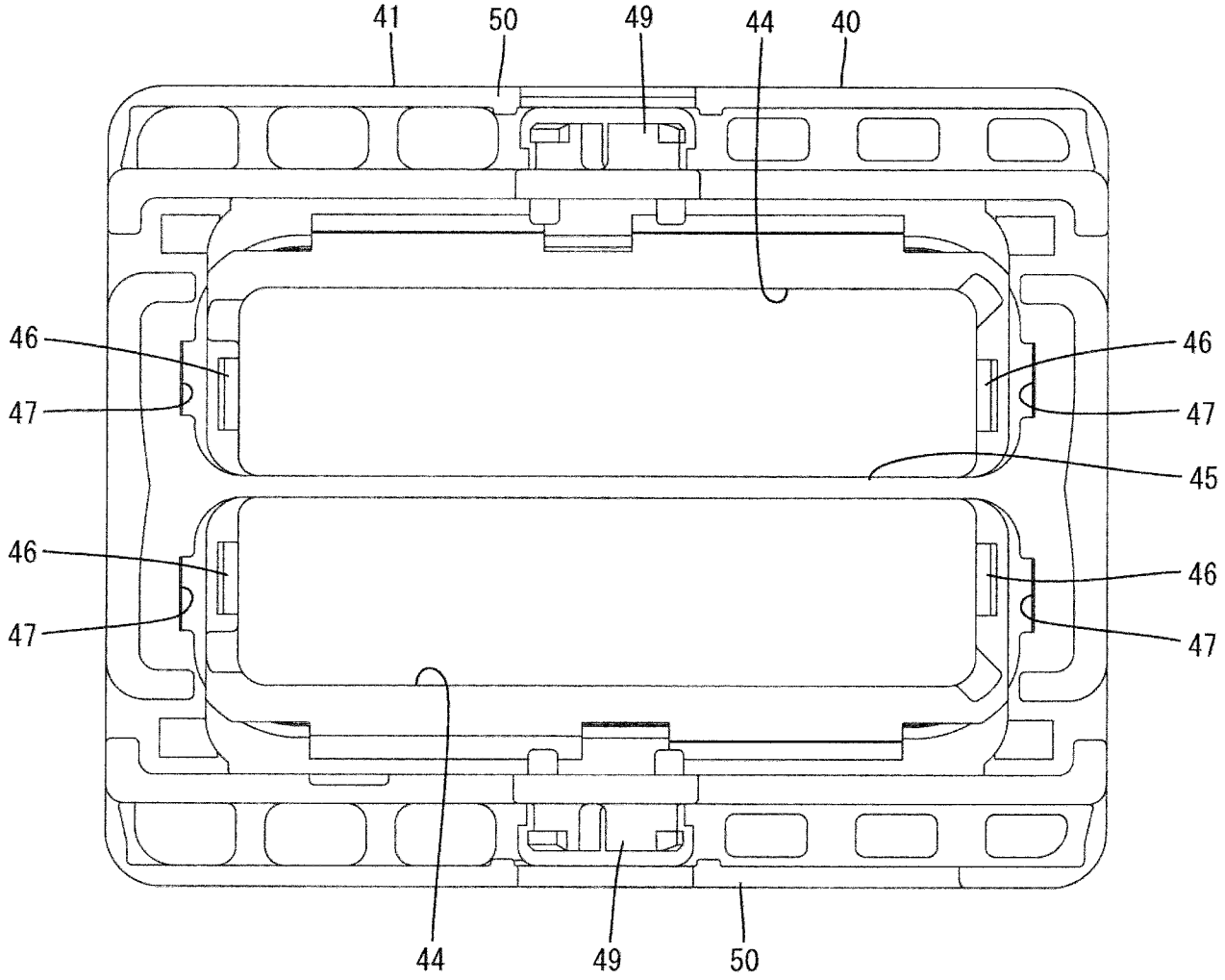
FIG. 7 is a rear view of the outer housing.

As shown in FIG. 7, the housing main body 41 is a substantially rectangular box with two accommodating chambers 44 penetrating in the front-back direction. The accommodating chambers 44 are substantially rectangular openings arranged one above the other and separated by a partition wall 45 extending in the width direction. Upper and lower inner lock receiving portions 46 are provided in the housing main body 41 on opposite side surfaces of the respective accommodating chambers 44. The inner connectors 10 are inserted into the accommodating chambers 44 from from behind, and the respective inner locks 17 are engaged resiliently with the corresponding inner lock receiving portions 46 so that the properly inserted inner connectors 10 are retained in the accommodating chambers 44 of the housing main body 41. Holder lock receiving portions 47 are provided behind the inner locks 17 on the opposite side surfaces of the accommodating chambers 44. The holder locks 23 are engaged resiliently with the corresponding holder lock receiving portions 47 when the inner connector 10 is inserted properly to prevent detachment of the holder 13 from the seal 12. Further, as shown in FIG. 2, a retainer insertion opening 48 is open on a side wall of the housing main body 41 for receiving the retainer.

Figure 6:
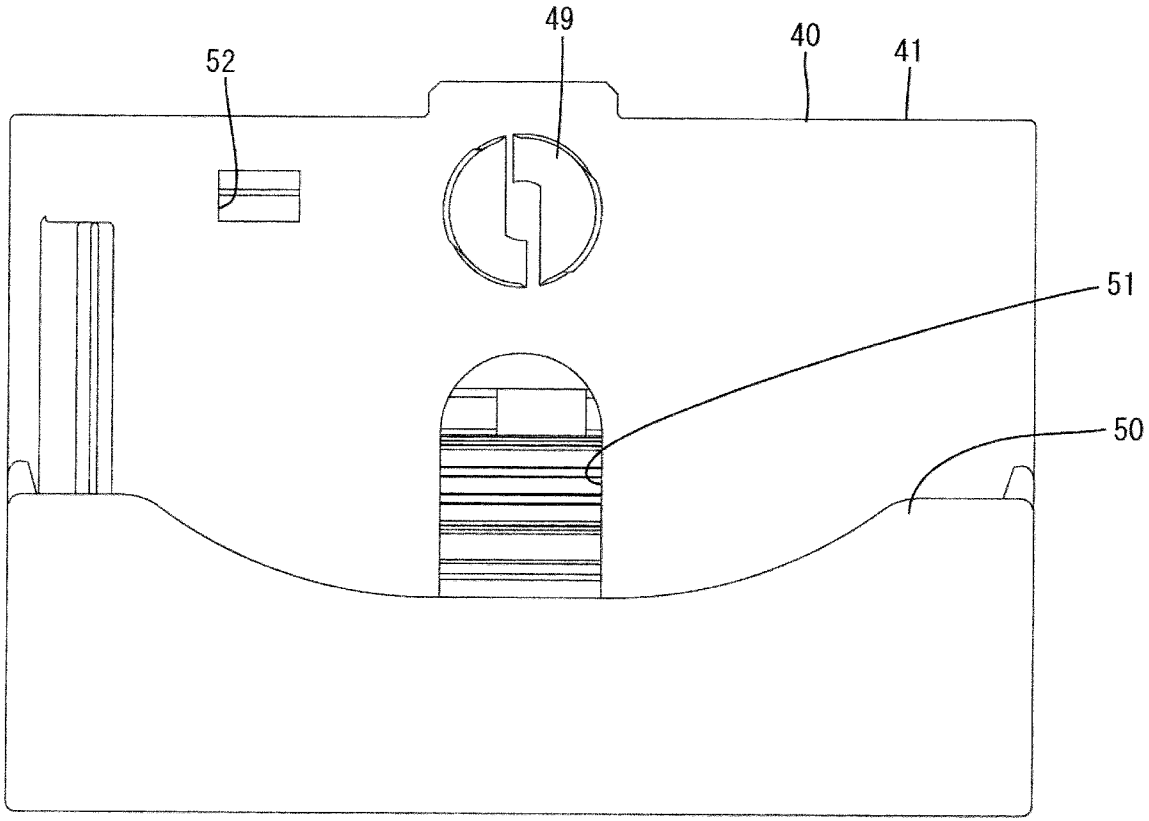
FIG. 6 is a plan view of an outer housing.

As shown in FIGS. 6 and 7, two substantially cylindrical support shafts 49 project from widthwise central parts of outer surfaces of rear end parts of upper and lower walls of the housing main body 41 for supporting the lever 70. Outer walls 50 cover outer sides of front end parts of the upper and lower walls of the housing main body 41, and outer peripheral parts of arms 72 of the lever 70 are inserted into spaces at inner sides of the outer walls 50. Further, introducing grooves 51 are formed in the upper and lower walls of the housing main body 41 and extend toward the support shafts 49, as shown in FIG. 6. The introducing grooves 51 guide unillustrated cam followers of the mating connector to cam grooves 74 of the lever 70.

Substantially rectangular lock receiving portions 52 are provided on the rear end parts of the upper and lower walls of the housing main body 41 at positions displaced toward one side from a widthwise center, as shown in FIG. 6. The lock receiving portions 52 are arranged side by side with the support shafts 49 in the width direction. Specifically, the lock receiving portion 52 is arranged to the left of the support shaft 49 on the upper wall while being arranged to the right of the support shaft 49 on the lower wall. Further, the lock receiving portions 52 penetrate through the upper and lower walls to open on the outer surfaces of the housing main body 41 and the accommodating chambers 44.

Figure 10:
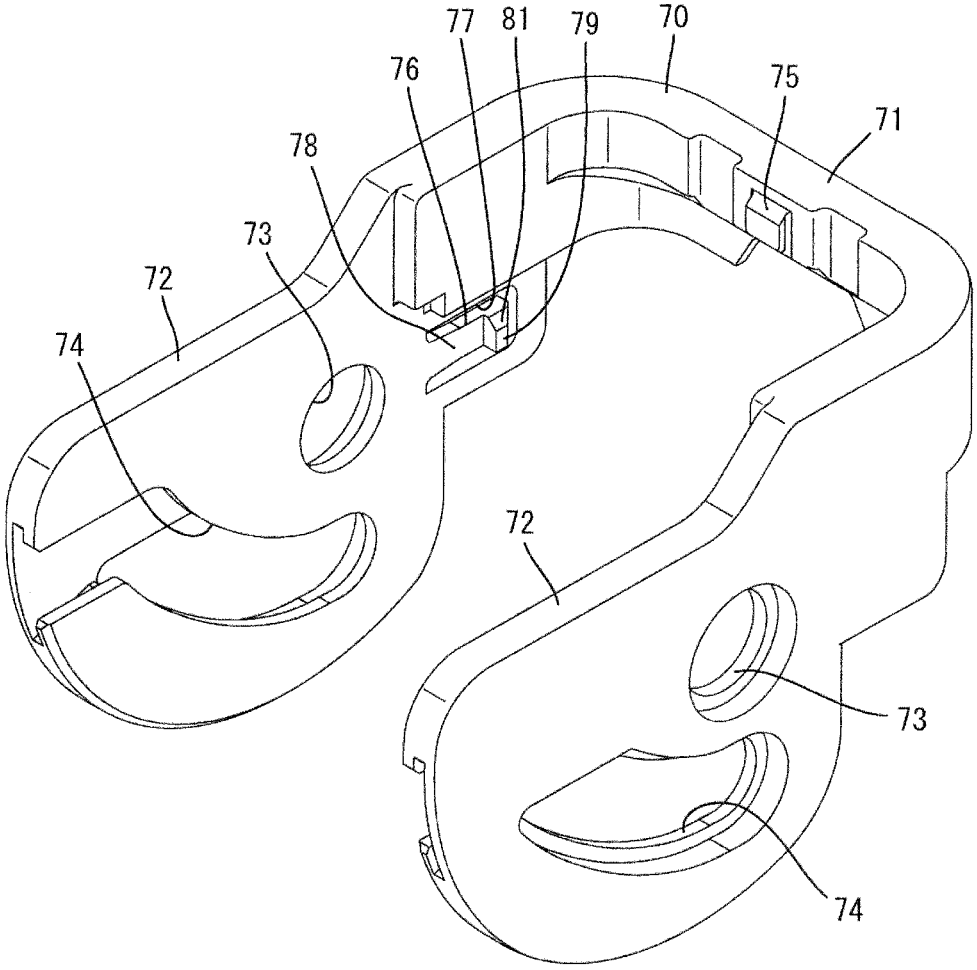
FIG. 10 is a perspective view of the lever.
Figure 11:
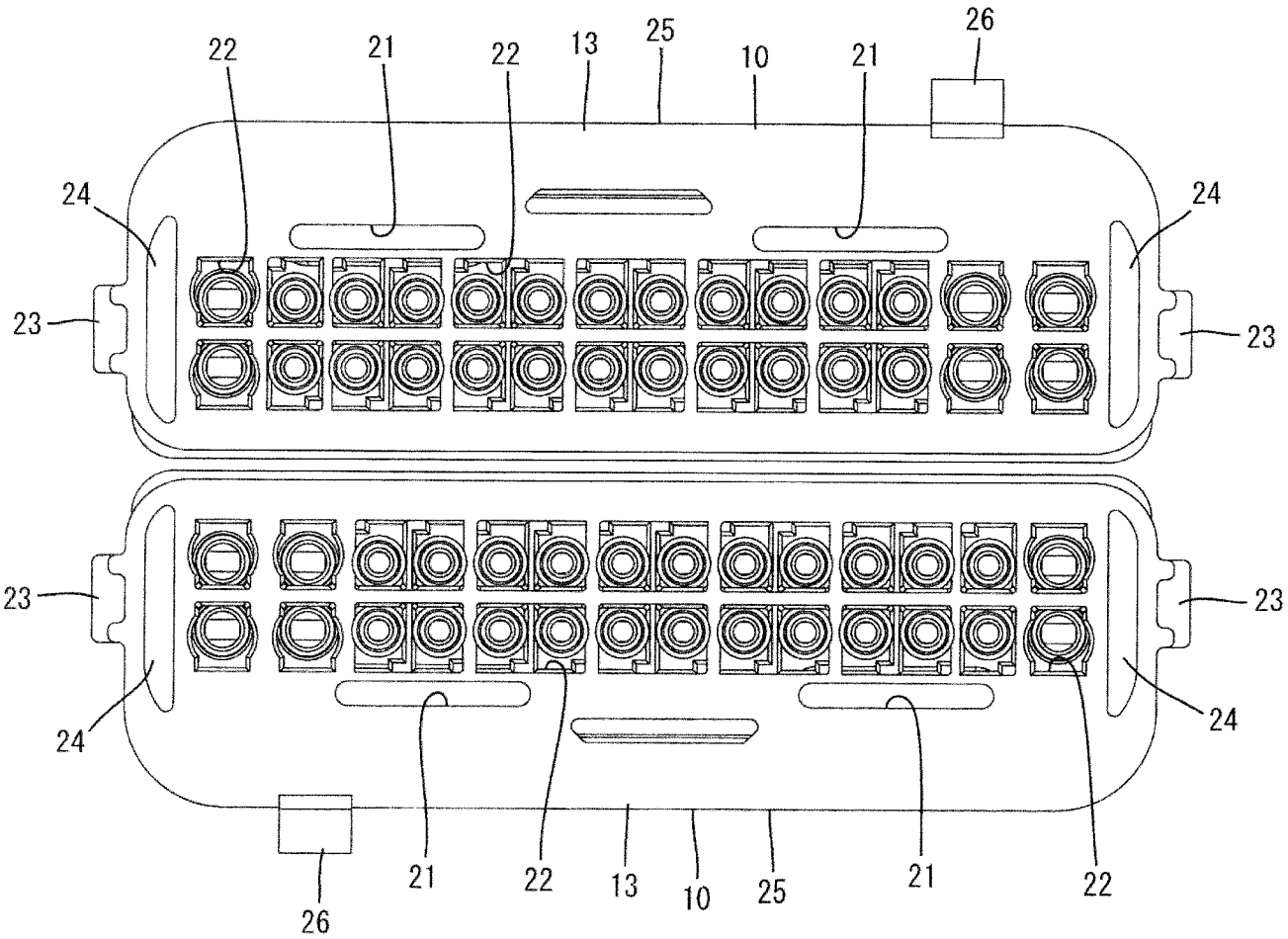
FIG. 11 is a rear view of the inner connector.

The lever 70 is made e.g. of synthetic resin and, as shown in FIG. 10, has a substantially U-shape defined by an operating portion 71 and two parallel arms 72 projecting from opposite ends of the operating portion 71. A lever lock 75 is provided on the inner surface of the operating portion 71. The arms 72 have bearing holes 73 for receiving the respective support shafts 49, and the cam grooves 74 are provided around the bearing holes 73. The cam grooves 74 penetrate through the arms 72 in a plate thickness direction except at an entrance on the outer peripheral edge of the arm 72.

The lever 70 is held rotatably on the outer housing 40 by fitting the support shafts 49 in the bearing holes 73 of the arms 72. It should be understood, however, that the invention also is applicable to different configurations of levers such as a single plate with a single bearing hole or a lever having a substantially linear displacement path, such as a slider. When the lever 70 is at the initial position shown in FIG. 4, the entrances of the cam grooves 74 face forward and the operating portion 71 is on a back side so that the cam followers of the mating connector can be inserted through the introducing grooves 51 and into the entrances of the cam grooves 74. The operating portion 71 then can be gripped to rotate the lever 70 counterclockwise in FIG. 4 so that the cam followers slide along surfaces of the cam grooves 74 to generate a cam action that pulls the mating connector toward the inner connectors 10 in the accommodating chambers 44. In this case, outer peripheral parts of the arms 72 subjected to connection resistance contact with the outer walls 50 to prevent the arms 72 from being deformed excessively. The mating connector and the inner connectors 10 are connected to a proper depth when the lever 70 reaches the connection position and the lever locks 75 engage resiliently with the respective lever lock receiving portions 43 of the wire cover 42 to hold the lever 70 at the connection position.

As shown in FIG. 10, resiliently deflectable locks 76 are provided on both arms 72 substantially between the bearing holes 73 and the operating portion 71. Each lock 76 is arranged in a U-shaped cut 77 formed in the arm 72. Specifically, each lock 76 includes a locking body 78 cantilevered toward the operating portion 71 in the cut 77 within a plate thickness range of the arm 72 and a locking projection 79 projecting in from an extending end of the locking body 78.

The lever 70 is held on the housing main body 41 at an assembled position where the locking projections 79 of the locking body 78 are fit into and engaged with the respective lock receiving portions 52 from outer sides. The locking projections 79 are arranged within the plate thickness ranges of the upper and lower walls of the housing main body 41 when fit in the lock receiving portions 52. Further, as shown in FIG. 3, the locking projection 79 has a rearward facing inclined surface 81 that is inclined forward toward the accommodating chamber 44 when fit in the lock receiving portion 52.

The lock receiving portions 52 are to the left of the support shaft 49 on the upper wall of the housing main body 41 and to the right of the support shaft 49 on the lower wall of the housing main body 41. Thus, assembled postures of the lever 70 and the wire cover 42 can be inverted from a state shown in FIG. 1 so that the orientation of the wires drawn out from the wire cover 42 can be changed laterally. Further, since one lock receiving portion 52 is provided on each of the upper and lower walls of the housing main body 41 and one lock 76 corresponds to each lock receiving portion 52, strengths of the lever 70 and the wire cover 42 can be ensured and the configuration can be simplified.

Figure 8:
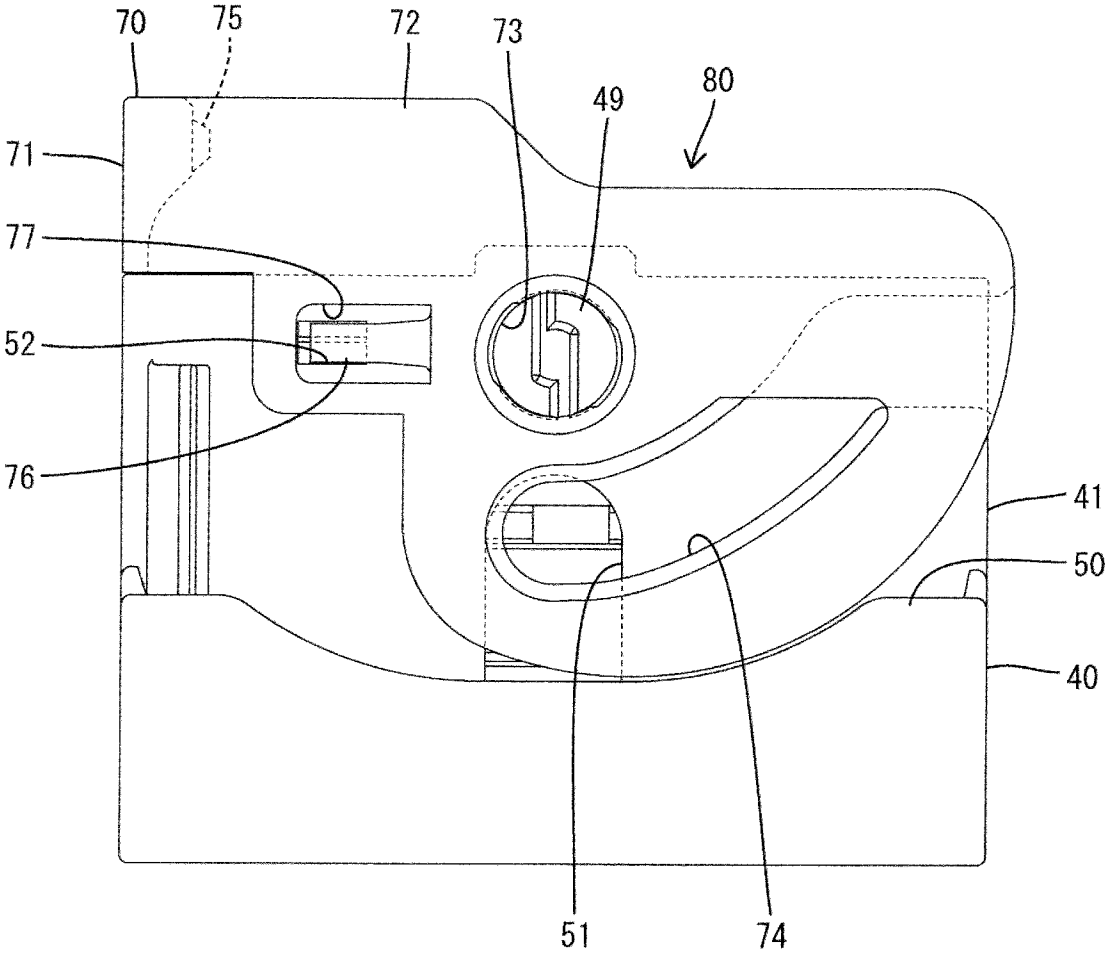
FIG. 8 is a plan view showing the lever at the assembled position on the outer housing.

In assembling, the locking projections 79 of the locks 76 of the lever 70 are engaged with the lock receiving portions 52 of the housing main body 41 from the outer sides and the lever 70 is held at the assembled position on the outer housing 40 in a state where the wire cover 42 is not mounted on the housing main body 41, as shown in FIG. 8. At this time, the operating portion 71 of the lever 70 is substantially continuous with a side wall of the housing main body 41 in the front-back direction, and a mounting space 80 for the wire cover 42 is ensured at a corresponding area behind the housing main body 41.

The housing main body 41 is transported to a wiring harness assembling site with the lever 70 held at the assembled position. The locks 76 are fit in and strongly engaged with the lock receiving portions 52 during transportation. Thus, even if an external force acts on the lever 70, the locks 76 and the lock receiving portions 52 are not easily unlocked.

The inner housing 11, the seal 12 and the holder 13 are assembled into the inner connector 10, as shown in FIG. 9, at the wiring harness assembling site. The terminal fittings 90 connected to the end portions of the wires 100 then are inserted into the respective cavities 14 of the inner housing 11 and the properly inserted terminal fittings 90 are locked by the locking lances 15. The inner connectors 10 then are inserted into the accommodating chambers 44 of the housing main body 41. When the inner connectors 10 are inserted properly into the accommodating chamber 44, the releasing portion 26 of the inner connector 10 engages the lock receiving portion 52 of the housing main body 41 from the inner side and the inner locks 17 and the holder locks 23 engage respectively with the inner lock receiving portions 46 and the holder lock receiving portions 47 to hold the inner connector 10 in the outer housing 40. At this time, the holder 13 is locked strongly to the housing main body 41 by locking actions of the holder locks 23 and the releasing portions 26 so that the seal 12 will not detach.

As shown in FIG. 3, the releasing portion 26 is fit into the lock receiving portion 52 of the housing main body 41 from the inner side and presses the lock 76 of the lever 70 out from the lock receiving portion 52 so that the lever 70 can rotate. Furthermore, the retainer is inserted through the retainer insertion opening 48 and into the retainer mounting hole 16 after the inner connectors 10 are inserted the accommodating chambers 44 of the housing main body 41 for locking the terminal fittings 90 redundantly in the cavities 14.

The wire cover 42 then is mounted on the rear of the housing main body 41 while covering the wires 100 extending from the inner connectors 10 and guiding the wires 100 to the outside through the one lateral side of the wire cover 42. Subsequently, as shown in FIG. 4, the lever 70 is rotated to the initial position so that the mating connector can be fit lightly into the housing main body 41. The lever 70 then can be rotated toward the connection position and displays a cam action that connects the lever-type connector with the mating connector. The inner connectors 10 connect properly to the mating connector when the lever 70 reaches the connection position and the terminal fittings 90 are connected electrically conductively to the mating terminals.

As described above, the locks 76 of the lever 70 are fit into the lock receiving portions 52 of the outer housing 40 from the outer sides so that the lever 70 is held strongly on the outer housing 40. Thus, the lever 70 will not be unlocked inadvertently during transit to to the wiring harness assembling site. Further, the releasing portion 26 of the inner connector 10 interacts with the locking portion 76 to separate the locking portion 76 from the lock receiving portion 52 when the inner connector 10 is inserted into the accommodating chamber 44 so that a locking state of the locking portion 76 and the lock receiving portion 52 is released automatically without depending on a tool or the like and the lever 70 can be rotated quickly thereafter. In addition, the lever 70 cannot be rotated if the inner connector is in a wrong insertion posture or erroneously inserted into the wrong accommodating chamber. Thus, erroneous insertion of the connector 10 can be avoided. As a result, it is not necessary to provide a dedicated structure for preventing erroneous insertion of the inner housings 11 and the entire configuration can be simplified.

Further, the inner connector 10 is held in the accommodating chamber 44 by fitting the releasing portion 26 into the lock receiving portion 52 from the inner side to enhance locking strength of the inner connector 10 in the outer housing 40. Furthermore, engaging the releasing portion 26 into the lock receiving portion 52 holds the holder 13 in the outer housing 40 and reliably prevents detachment from the seal 12. As a result, the seal 12 stably exhibits sealing.

The invention is not limited to the above described and illustrated embodiment. For example, the following modes also are included in the scope of the invention.

The outer housing may have only one accommodating chamber.

The lever may be supported on the wire cover.

The inner connector may be held in the accommodating chamber of the outer housing only via the release without including the inner locks.

The release may project from an outer surface of the inner housing instead of being provided on the holder.

The release may not be fit into the lock receiving portion when the inner connector is inserted into the accommodating chamber.

The release may operate the lock via a member interposed between the release and the lock when the inner connector is inserted into the accommodating chamber.

What is claimed is:

1. A lever-type connector, comprising:

an outer housing including at least one accommodating chamber, at least one lock receiving portion at a position on the outer housing corresponding to the accommodating chamber and being open from the accommodating chamber to an outer surface that faces outward on the outer housing;

an inner connector connectable to a mating connector by being inserted into the accommodating chamber; and a lever displaceably mounted on the outer housing and configured to move the mating connector to a position where the mating connector is connectable to the inner connector, the lever including at least one lock for holding the lever on the outer housing by being fit into the lock receiving portion when the lever is assembled with the outer housing, wherein:

the inner connector includes at least one release for interacting with the lock to separate the lock from the lock receiving portion when the inner connector is inserted into the accommodating chamber.

2. The lever-type connector of claim 1, wherein the lever is mounted rotatably on the outer surface of the outer housing.

3. The lever-type connector of claim 1, wherein the lock is to be fit inwardly into the lock receiving portion from the outer surface.

4. The lever-type connector of claim 1, wherein the releasing portion is provided for pressing the lock outward from the accommodating chamber toward the outer surface to separate the lock from the lock receiving portion when the inner connector is inserted into the accommodating chamber.

5. The lever-type connector of claim 1, wherein the inner connector is held and retained in the accommodating chamber by fitting the releasing portion into the lock receiving portion from the terminal accommodating chamber toward the outer surface.

6. The lever-type connector of claim 1, wherein the inner connector includes an inner housing with at least one cavity for receiving a terminal fitting connected to an end portion of a wire, a seal arranged to face the inner housing to seal the wire in a fluid-tight manner, a holder facing the seal, and the releasing portion projecting on an outer surface of the holder.

7. The lever-type connector of claim 6, wherein the seal includes a seal hole at a position communicating with the cavity, the seal hole being configured to receive the wire, and the holder including a through hole at a position communicating with the seal hole, the through hole loosely receiving the wire.

8. The lever-type connector of claim 1, wherein the outer housing includes a housing main body with the accommodating chamber and a wire cover mounted on the housing main body to at least partly cover the wire drawn out from the inner connector.

9. The lever-type connector of claim 8, wherein the lock receiving portion is formed at a part of the outer housing that includes the housing main body.

* * * * *